US010126692B2

(12) United States Patent
Aoki et al.

(10) Patent No.: US 10,126,692 B2
(45) Date of Patent: Nov. 13, 2018

(54) POWER SUPPLY CONTROL DEVICE AND IMAGE FORMING APPARATUS

(71) Applicant: KONICA MINOLTA, INC., Chiyoda-ku, Tokyo (JP)

(72) Inventors: Mikiyuki Aoki, Toyohashi (JP); Seiichi Kirikubo, Toyohashi (JP); Taku Kimura, Toyokawa (JP); Akinori Kimata, Toyokawa (JP); Takeshi Tamada, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 4 days.

(21) Appl. No.: 15/440,741

(22) Filed: Feb. 23, 2017

(65) Prior Publication Data

US 2017/0261892 A1 Sep. 14, 2017

(30) Foreign Application Priority Data

Mar. 11, 2016 (JP) ..... 2016-048914

(51) Int. Cl.
*H05B 1/02* (2006.01)
*G03G 15/20* (2006.01)
*G03G 15/00* (2006.01)

(52) U.S. Cl.
CPC ..... *G03G 15/205* (2013.01); *G03G 15/2039* (2013.01); *G03G 15/80* (2013.01)

(58) Field of Classification Search
CPC .. G03G 15/205; G03G 15/80; G03G 15/2003; G03G 15/2072; H05B 1/0241; H05B 3/0066

(Continued)

(56) References Cited

U.S. PATENT DOCUMENTS 4,716,509 A * 12/1987 Roccucci ..... H02M 3/3378 363/26
5,789,723 A * 8/1998 Hirst ..... G03G 15/80 219/216

(Continued)

FOREIGN PATENT DOCUMENTS

JP 08098393 A 4/1996
JP 10254264 A 9/1998

(Continued)

*Primary Examiner* — Mark Paschall

(74) *Attorney, Agent, or Firm* — Holtz, Holtz & Volek PC

(57) ABSTRACT

A power supply control device including a chopper circuit generating a heater current for a halogen heater, a current feedback circuit generating a current feedback signal indicating a current amount based on an amount of the heater current, and a constant current circuit performing pulse-width modulation of the heater current amount according to a difference between a target heater current amount and the current amount indicated by the current feedback signal. The current feedback circuit switches between methods at least including a first method and a second method for generating the current feedback signal. The current feedback signal indicates a greater current amount with the first method than with the second method, and the current feedback circuit uses the first method during a period with a predetermined time length starting from when the halogen heater is turned on, and uses the second method after elapse of the period.

18 Claims, 7 Drawing Sheets

(58) Field of Classification Search
USPC ... 219/216, 497, 501, 507, 509, 510, 121.54
See application file for complete search history.

(56) References Cited

U.S. PATENT DOCUMENTS

| | | | | |
|---|---|---|---|---|
| 6,317,571 | B1 * | 11/2001 | Adams | G03G 15/2003 399/67 |
| 6,369,513 | B1 | 4/2002 | Kanazawa | |
| 7,122,767 | B2 * | 10/2006 | Sato | H05B 1/0241 219/216 |
| 2007/0059016 | A1 * | 3/2007 | Sato | G03G 15/80 399/88 |
| 2007/0212103 | A1 * | 9/2007 | Kikuchi | G03G 15/0283 399/88 |
| 2008/0290811 | A1 * | 11/2008 | Yoshida | H02M 3/156 315/225 |

FOREIGN PATENT DOCUMENTS

| | | | |
|---|---|---|---|
| JP | 2001069667 | A | 3/2001 |
| JP | 2008159329 | A | 7/2008 |
| JP | 2012253878 | A | 12/2012 |

* cited by examiner

POWER SUPPLY CONTROL DEVICE AND IMAGE FORMING APPARATUS

CROSS-REFERENCE TO RELATED APPLICATIONS

This application is based on application No. 2016-048914 filed in Japan, the contents of which are hereby incorporated by reference.

BACKGROUND (1) Technical Field

The present invention is related to power supply control devices and image forming apparatuses. Specifically, the present invention is related to a technology of preventing destruction of a power supply control device upon cold start without extended warm-up time.

(2) Description of the Related Art

Image forming apparatuses utilizing electrophotography have heat sources for heat-fixing toner onto recording sheets. Among various types of such heat sources, halogen heaters are widely used for achieving low cost. Fast switching of power supply to halogen heaters can be achieved by using step-down chopper circuits.

However, halogen heaters may be problematic for inducing high inrush current, particularly immediately after they are turned on from a cold state (an off state with low halogen heater temperature). This is because halogen heaters have low electrical resistance in the cold state.

The flow of high inrush current through a halogen heater results in voltage drop of a power supply line connected to the halogen heater and increases the risk of consequent problems such as flickering of fluorescent lamps connected to the power supply line.

Further, particularly when a step-down chopper circuit connected to a halogen heater includes an insulated gate bipolar transistor (IGBT) with low withstand voltage, turning on the halogen heater in the cold state (referred to in the following as a cold start of a halogen heater) at a high duty cycle may result in destruction of the IGBT.

While IGBT destruction by inrush current can be prevented by using an IGBT with high withstand voltage, this measure is not practical because the use of an IGBT with high withstand voltages is costly.

Another measure for preventing IGBT destruction by inrush current is reducing the pulse-width modulation duty cycle initially used following the cold start of a halogen heater, and thereby suppressing inrush current. However, the longer the reduced duty cycle is used, the longer the warm-up time of the halogen heater.

In view of such problems, a conventional technology has been proposed, for example, of restricting input voltage of a lamp for a predetermined amount of time from when the lamp is turned on so that the current flowing through the lamp has a value smaller than a permissible current value of the lamp, and commencing pulse-width modulation after elapse of the predetermined time amount. One example of this conventional technology can be found disclosed in Japanese Patent Application Publication No.: 2001-069667.

Restricting input voltage by employing such a configuration suppresses inrush current and thereby prevents IGBT destruction.

Meanwhile, one of the benchmarks used to assess the performance of image forming apparatuses is the amount of time required for an initial page to be printed and output from when a user instruction for printing is received. This amount of time is referred to as first copy output time (FCOT), and the shorter the FCOT, the more desirable.

However, with the conventional technology described above, input voltage is always restricted for a predetermined amount of time every time the halogen lamp is turned on, and due to this, a long amount of time is always required for startup. That is, applying the conventional technology described above to an image forming apparatus results in an extension in the amount of time required for warm up and a consequent extension in FCOT, due to the conventional technology requiring restricting input voltage for a certain amount of time.

SUMMARY

In view of such problems, the present invention aims to provide a power supply control device and an image forming apparatus that suppress inrush current flowing upon cold start of a halogen heater without extending warm-up time.

One aspect of the present invention is a power supply control device in an image forming apparatus that heat-fixes a toner image by using a halogen heater, the power supply control device receiving AC power from an external power source and supplying the halogen heater with a heater current, the power supply control device including: a rectifier circuit performing full-wave rectification of the AC power to output full-wave rectified power; a chopper circuit generating the heater current from the full-wave rectified power; a current feedback circuit generating a current feedback signal indicating a current amount based on an amount of the heater current; and a constant current control circuit performing pulse-width modulation of the amount of the heater current according to a difference between a target amount of the heater current and the current amount indicated by the current feedback signal, wherein the current feedback circuit is capable of switching between a plurality of methods for generating the current feedback signal, the methods at least including a first method and a second method, the current feedback signal indicating a greater current amount with the first method than with the second method, and the current feedback circuit uses the first method during an initial period that is a period with a predetermined time length starting from when the halogen heater is turned on, and uses the second method after elapse of the initial period.

BRIEF DESCRIPTION OF THE DRAWINGS

These and other objects, advantages and features of the present invention will become apparent from the following description thereof taken in conjunction with the accompanying drawings, which illustrate a specific embodiment of the present invention.

In the drawings.

DESCRIPTION OF EMBODIMENT

The following embodiment describes a form of implementation of the power supply control device and the image forming apparatus pertaining to the present invention, with reference to the accompanying drawings.

[1] Structure of Image Forming Apparatus

The following describes the structure of the image forming apparatus pertaining to the present invention.

Figure 1:
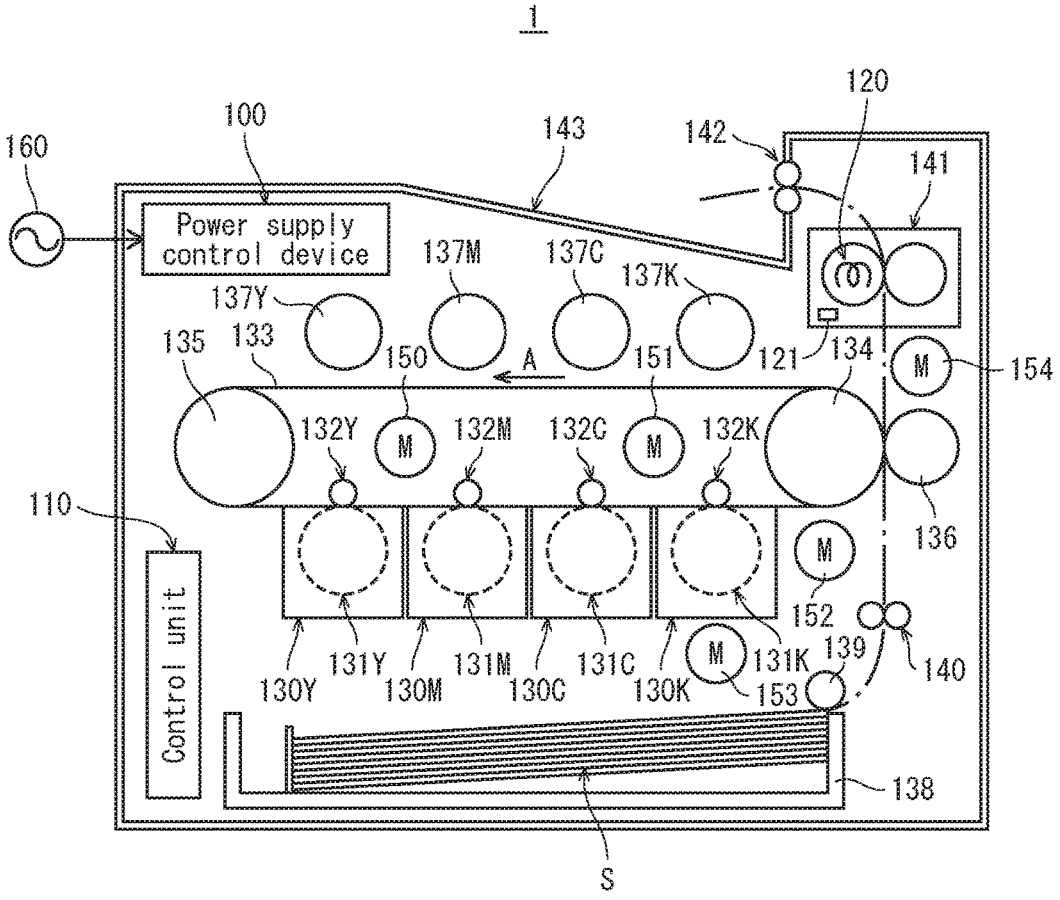
FIG. 1 illustrates major components of an image forming apparatus pertaining to an embodiment of the present invention.

FIG. 1 illustrates an image forming apparatus 1, which is one form of implementation of the image forming apparatus pertaining to the present invention. The image forming apparatus 1 is a color printer having the tandem system, and includes a power supply control device 100. The power supply control device 100 is a low voltage power supply, and receives AC power from an external power source 160 and supplies various components of the image forming apparatus 1 with power. For example, the power supplied by the power supply control device 100 is used for driving and controlling various components of the image forming apparatus 1, and for driving a heater. Further, the image forming apparatus 1 includes a control unit 110. The control unit 110 controls the operation of various components of the image forming apparatus 1, including the power supply control device 100.

The control unit 110 is connected to one or more devices external to the image forming apparatus 1 via a network (not illustrated in the drawings) such as a local area network (LAN). The control unit 110, when receiving a print job from an external device via the network, causes image forming units 130Y (Y for yellow), 130M (M for magenta), 130C (C for cyan), and 130K (K for black) of the image forming apparatus 1 to respectively create a Y toner image, an M toner image, a C toner image, and a K toner image.

The image forming units 130Y, 130M, 130C, and 130K respectively include photoreceptor drums 131Y, 131M, 131C, and 131K. Further, each image forming unit 130 creates a toner image of the corresponding one of the colors Y, M, C, and K by using a charger device, a light exposure device, and a developer device (which are not illustrated in the drawings). Specifically, each image forming unit 130 creates a toner image of the corresponding color by electrically charging the outer circumferential surface of a corresponding one of photoreceptor drums 131Y, 131M, 131C, and 131K uniformly, forming an electrostatic latent image on the photoreceptor drum 131 by performing light exposure of the outer circumferential surface according to the print job, and by visualizing the electrostatic latent image by supply of toner.

The toner images of the colors Y, M, C, and K, respectively formed on the outer circumferential surfaces of the photoreceptor drums 131Y, 131M, 131C, and 131K, are electrostatically transferred onto an intermediate transfer belt 133 by primary transfer rollers 132Y, 132M, 132C, and 132K, respectively. Here, the toner images are transferred to overlap one another on the intermediate transfer belt 133, and thus, so that a color toner image is formed on the intermediate transfer belt 133. Note that toner may remain on the outer circumferential surfaces of the photoreceptor drums 131Y, 131M, 131C, and 131K after the above-described transferring of toner images. However, a cleaner is provided to remove such toner.

The intermediate transfer belt 133 is suspended in tensioned state across a drive roller 134 and a driven roller 135, and rotates in the direction indicated by arrow A in FIG. 1. The drive roller 134 forms a secondary transfer nip with a secondary transfer roller 136. The secondary transfer roller 136 is disposed at the other side of the intermediate transfer belt 133 from the drive roller 134, and presses against the drive roller 134.

The image forming apparatus 1 also has a sheet tray 138. The sheet tray 138 accommodates recording sheets S, which are fed one by one onto a sheet transport path (indicated by the dashed dotted line in FIG. 1) by a pickup roller 139. One recording sheet S is fed onto the sheet transport path as the color toner image on the intermediate transfer belt 133 is carried to the secondary transfer nip by rotation of the intermediate transfer belt 133.

After being fed onto the sheet transport path, the recording sheet S comes to a temporary halt at a timing roller pair 140 to adjust transport timing, before being transported to the secondary transfer nip to receive electrostatic transfer of the color toner image. After the color toner image is transferred thereon, the recording sheet S advances to a fixing device 141 that heat-fixes the color toner image onto the recording sheet S. Subsequently, the recording sheet S is ejected onto an eject tray 143 by an eject roller pair 142.

Note that the fixing device 141 includes a halogen heater 120 as a built-in heat source, and the temperature of the fixing device 141 rises as power is supplied from the power control device 100. Further, the fixing device 141 also includes a temperature sensor 121 that detects the temperature of the fixing device 141 (in the following, the temperature of the fixing device 141 detected by the temperature sensor 121 is referred to as temperature T). The temperature T is referred to by the control unit 110 in providing the power supply control device 100 with a control signal for feedback control.

Further, the image forming apparatus 1 includes various motors, such as a color developer device motor 150, a color photoreceptor motor 151, a main motor 152, a black developer device motor 153, and a fixing device motor 154. The color developer device motor 150 drives the developer devices of the image forming units 130Y, 130M, and 130C. The color photoreceptor motor 151 drives the photoreceptor drums 131Y, 131M, and 131C to rotate.

The main motor 152 drives rollers for sheet transport between the pickup roller 139 and the secondary transfer roller 136, and also drives the intermediate transfer belt 133 and the photoreceptor drum 130K. The black developer device motor 153 drives the developer device of the image forming unit 130K. The fixing device motor 154 drives the fixing device 141.

[2] Structure Of Power Supply Control Device 100

The following describes the structure of the power supply control device 100.

Figure 2:
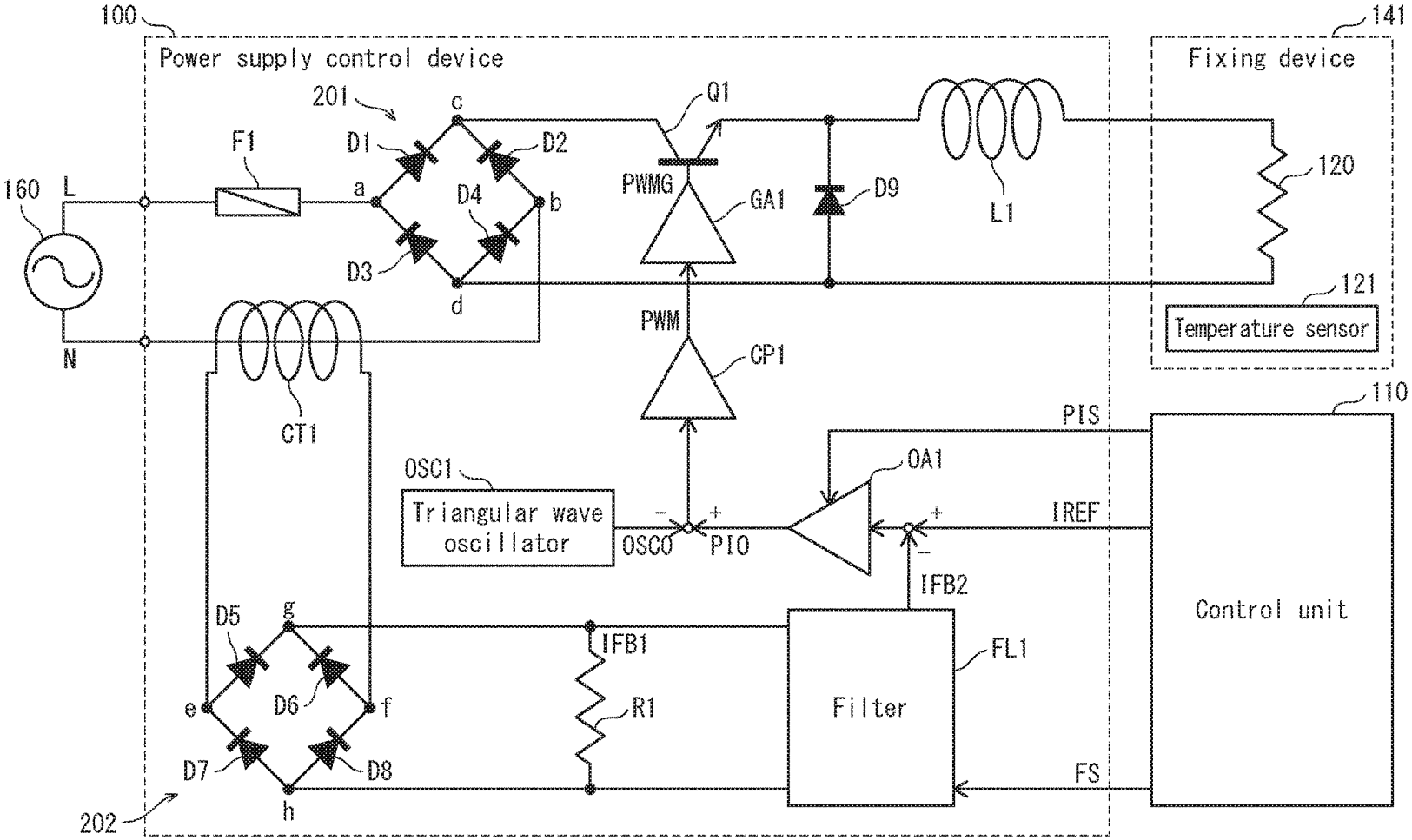
FIG. 2 is a circuit diagram illustrating main components of a power supply control device 100.

As illustrated in FIG. 2, the power supply control device 100 receives AC power from the external power source 160 and supplies the halogen heater 120 with DC power. Specifically, the power supply control device 100 has a bridge rectifier circuit 201 for rectifying the AC power, and a step-down chopper circuit for reducing voltage level. Further, the power supply control device 100 includes a current feedback circuit so that the step-down chopper circuit can be controlled to output constant current.

(2-1) Bridge Rectifier Circuit 201

The bridge rectifier circuit 201 is composed of diodes D1, D2, D3, and D4. As illustrated in FIG. 2, the live (L) wire of the external power source 160 is connected to point a of the bridge rectifier circuit 201 via a fuse F1. Meanwhile, the neutral (N) wire of the external power source 160 is connected to point b of the bridge rectifier circuit 201. The bridge rectifier circuit 201 performs full-wave rectification of the AC power, and outputs DC power from point c and point d.

(2-2) Step-Down Chopper Circuit

The step-down chopper circuit is composed of a switch element Q1, a flyback diode D9, and a reactor L1. For example, the switch element Q1 is an insulated-gate bipolar transistor (IGBT) whose collector terminal is connected to point c of the bridge rectifier circuit 201, whose emitter terminal is connected to the cathode terminal of the flyback diode D9 and one terminal of the reactor L1, and whose gate terminal is connected to the output terminal of a gate amplifier GAL The other terminal of the reactor L1 and the anode terminal of the flyback diode D9 are connected to the halogen heater 120. The anode terminal of the flyback diode D9 is also connected to point d of the bridge rectifier circuit 201.

The switch element Q1 switches on and off at a duty cycle dependent upon a gate signal PWMG that the gate amplifier GA1 outputs. Thus, pulse-width modulation of the input voltage of the halogen heater 120 is achieved.

While the switch element Q1 is on, the step-down chopper circuit supplies the halogen heater 120 with heater current whose increase rate is suppressed by the reactor L1. Meanwhile, while the switch element Q1 is off, electrical energy accumulated in the reactor L1 causes the heater current to circulate flowing from the reactor L1 to the halogen heater 120 and then to the flyback diode D9 before returning to the reactor L1 once again.

(2-3) Current Feedback Circuit

The current feedback circuit includes a current transformer CT1, a bridge rectifier circuit 202, and a fixed resistor R1.

(2-3-1) From Current Transformer CT1 to Fixed Resistor R1

The current transformer CT1 is disposed between the N wire of the external power source 160 and point b of the bridge rectifier circuit 201, and detects the amount of heater current supplied to the halogen heater 120.

The bridge rectifier circuit 202 is composed of diodes D5, D6, D7, and D8. Points e and f of the bridge rectifier circuit 202 are connected to the current transformer CT1. The bridge rectifier circuit 202 performs full-wave rectification of the secondary current (detection current) of the current transformer CT1.

The fixed resistor R1 is connected to points g and h of the bridge rectifier circuit 202. The fixed resistor R1 generates a voltage signal (full-wave rectification signal) IFB1 from the output current of the bridge rectifier circuit 202.

(2-3-2) Filter FL1

The filter FL1 receives the full-wave rectification signal IFB1 and outputs a current feedback signal IFB2. Further, the filter FL1 receives a filter characteristic selection signal FS from the control unit 110 and switches its filter characteristic between average detection and quasi-peak detection, in accordance with the filter characteristic selection signal FS.

Figure 3:
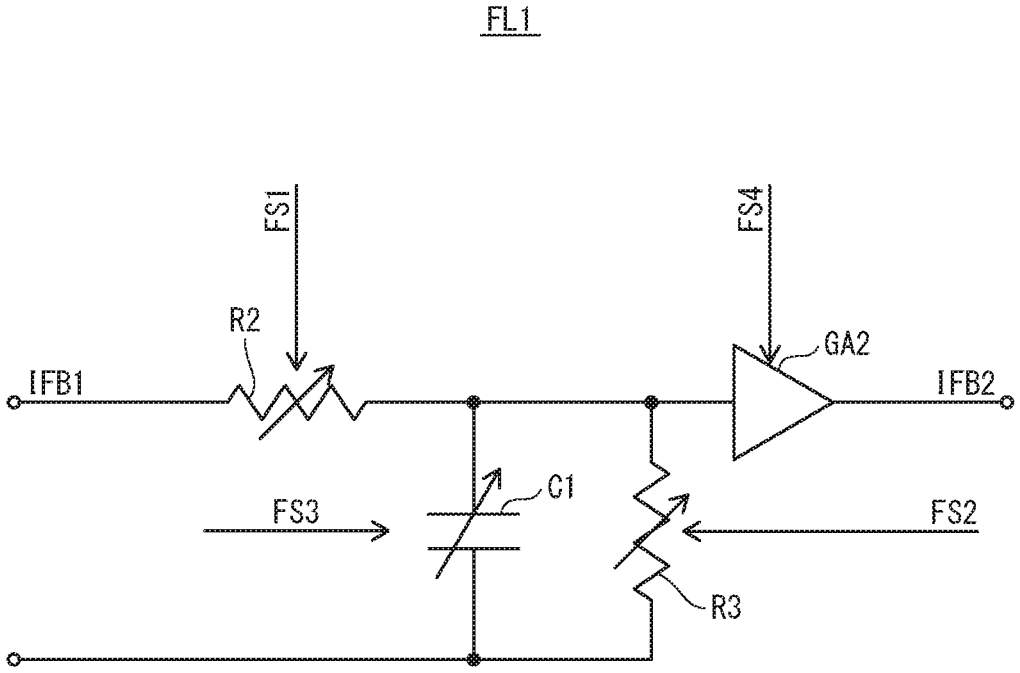
FIG. 3 is a circuit diagram illustrating main components of a filter FL1.

FIG. 3 is a circuit diagram illustrating main components of the filter FL1. Specifically, the filter FL1 is a so-called resistor-capacitor filter (RC filter), and the filter characteristic of the filter FL1 changes depending upon the RC time constant. As illustrated in FIG. 3, the filter FL1 includes variable resistors R2 and R3, a variable capacitor C1, and an amplifier GA2.

One terminal of the variable resistor R2 is connected to the capacitor C1, the variable resistor R3, and the amplifier GA2. The other terminal of the variable resistor R2 is connected to one input terminal of the filter FL1.

The terminals of the capacitor C1 and the variable resistor R3 that are not connected to the variable resistor R2 are connected to the other input terminal of the filter FL1. The amplifier GA2 amplifies the signal input thereto, and outputs a current feedback signal IFB2 to the output terminal of the filter FL1.

When the filter characteristic selection signal FS that the filter FL1 receives from the control unit 110 changes, one or more of the switching signals FS1, FS2, and FS3 change. Thus, one or more of the resistance of the resistor R2, the resistance of the resistor R3, and the capacitance of the capacitor C1, which respectively correspond to the switching signals FS1, FS2, and FS3, change.

Figure 7:
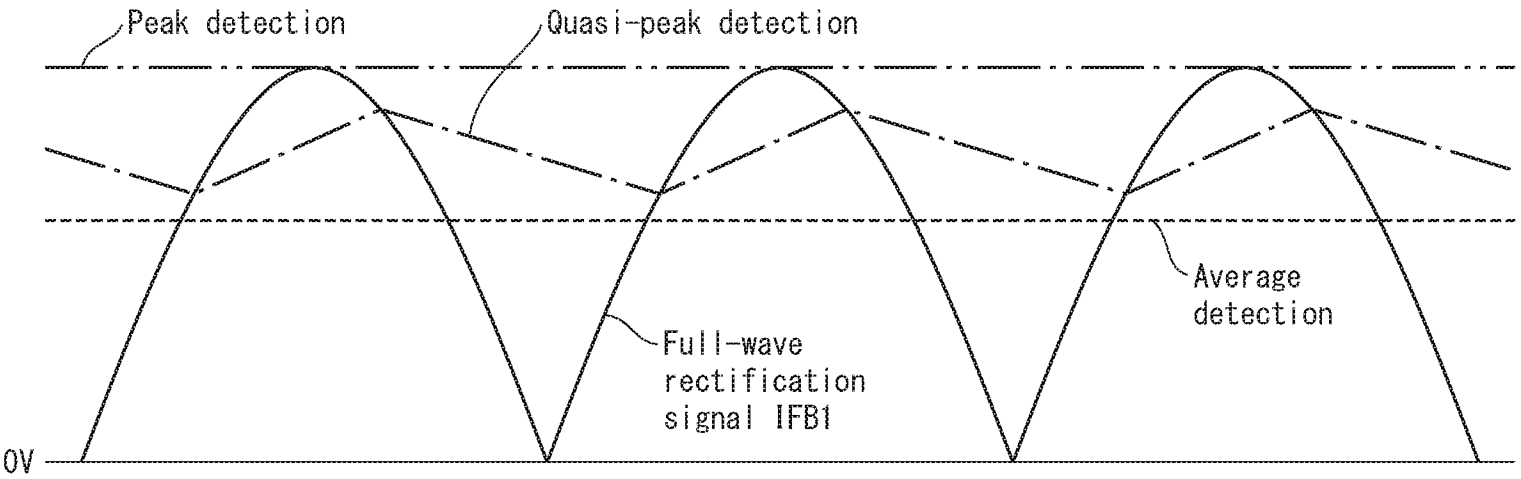
FIG. 7 shows graphs exemplifying current feedback signals IFB2 acquired from a full-wave rectification signal IFB1 through average detection, quasi-peak detection, and peak detection.

In the present embodiment, the filter characteristic of the filter FL1 switches between average detection and quasi-peak detection (illustrated in FIG. 7). The switching from average detection to quasi-peak detection is achieved by decreasing the charge time constant of the filter FL1, increasing the discharge time constant of the filter FL1, and/or the like. Further, quasi-peak detection is an intermediate filter characteristic that is between average detection and peak detection, as illustrated in FIG. 7.

Note that the switching of the filter characteristic of the filter FL1 may be achieved by using an analog circuit or by using a combination of a digital circuit and software.

(2-3-3) From Phase Compensator OA1 to Gate Amplifier GA1

A phase compensator OA1 is provided that performs phase compensation and thereby prevents output voltage oscillation due to current feedback. Specifically, when the control unit 110 outputs a heater current instruction signal IREF, which is a signal indicating target heater current amount, the phase compensator OA1 receives a signal acquired by subtracting the current feedback signal IFB2 from the heater current instruction signal IREF.

Further, in order to adapt to the change in response of the filter FL1 triggered by the filter characteristic selection signal FS, the phase compensator OA1 receives a PI constant selection signal PIS from the control unit 110, and changes its response according to the PI constant selection signal PIS. The PI constant selection signal PIS causes the proportional-integral (PI) constant of the phase compensator OA1 to switch. Receiving such input, the phase compensator OA1 outputs a PI signal PIO.

Further, a triangular wave oscillator OSC1 is provided that generates a triangular voltage output signal OSCO.

Figure 4A:
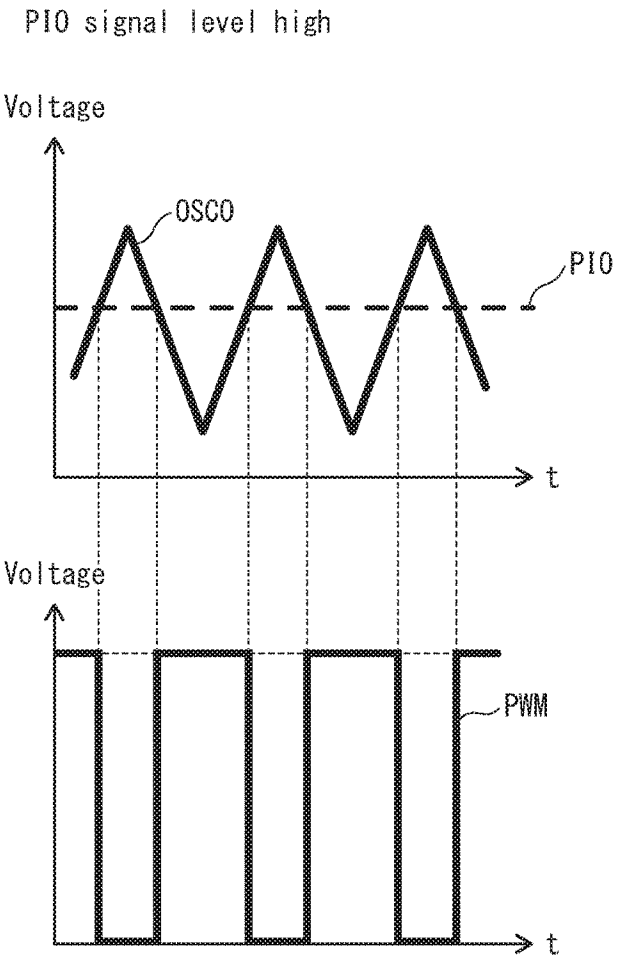
FIG. 4A shows graphs indicating an example of a relationship between a PI signal PIO and a pulse signal PWM output by a comparator CP1 when the PI signal PIO has high signal level.
Figure 4B:
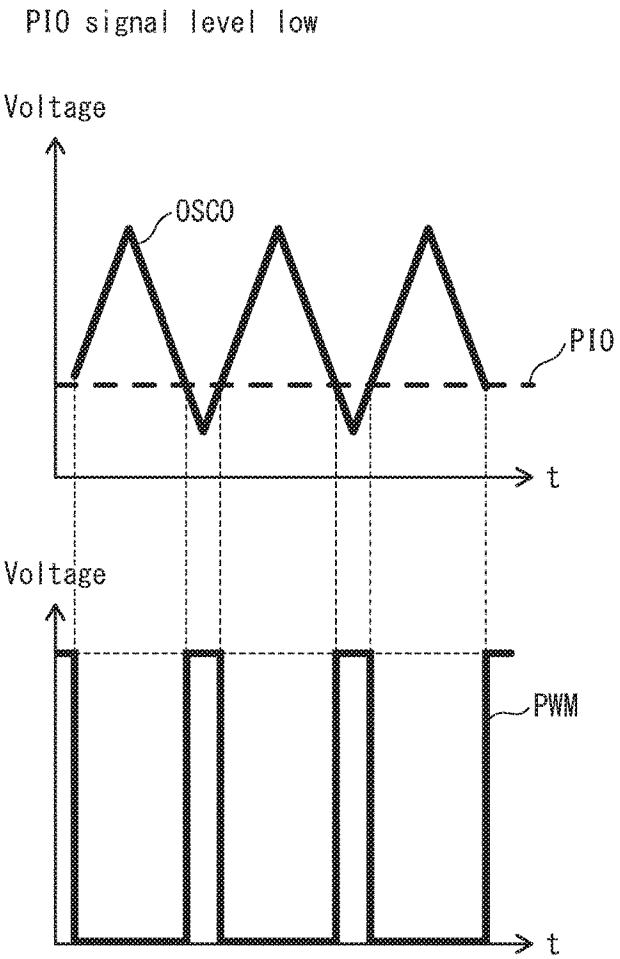
FIG. 4B shows graphs indicating an example of a relationship between the PI signal PIO and the pulse signal PWM output by the comparator CP1 when the PI signal PIO has low signal level.

Further, a comparator CP1 is provided that generates a pulse signal from a voltage signal that is acquired by subtracting the triangular output signal OSCO from the PI signal PIO. Specifically, as illustrated in FIG. 4, the triangular output signal OSCO has a constant signal level. Thus, when the signal level of the PI signal PIO changes, the duty cycle of the pulse signal PWM that the comparator CP1 outputs changes in accordance with the change in signal level of the PI signal PIO.

The gate amplifier GA1 amplifies the pulse signal PWM and outputs the gate signal PWMG. The switch element Q1 switches on and off according to this gate signal PWMG, whereby pulse-width modulation of the input voltage of the halogen heater 120 is achieved.

This configuration achieves performing feedback control of the heater current such that the heater current instruction signal IREF and the current feedback signal IFB2 match one another.

Note that in this embodiment, the current feedback circuit, the filter FL1, the phase compensator OA1, the triangular wave oscillator OSC1, the comparator CP1, the gate amplifier GA1, and the step-down chopper circuit constitute a constant current control circuit.

[3] Structure Of Control Unit 110

The following describes the structure of the control unit 110.

Figure 5:
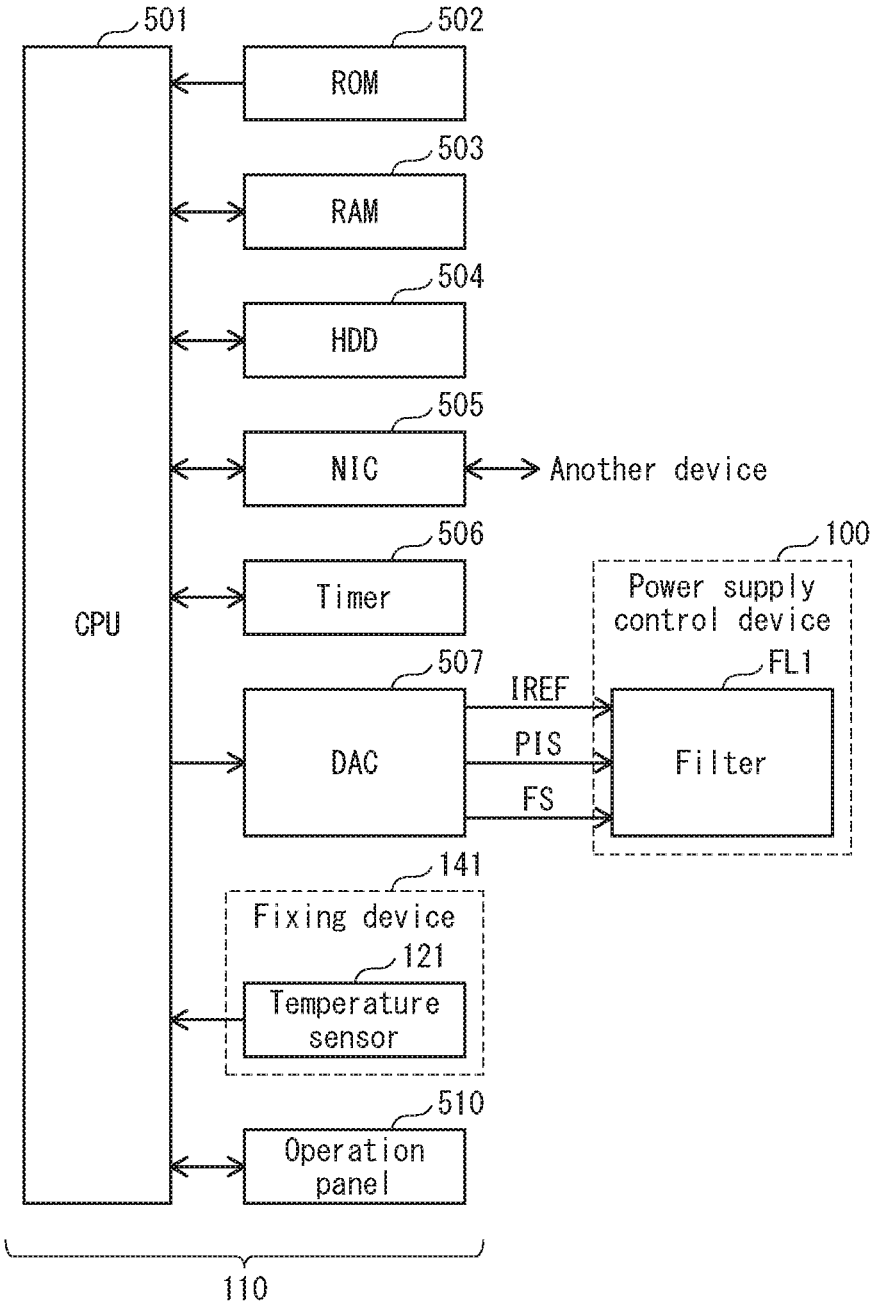
FIG. 5 is a block diagram illustrating main components of a control unit 110.

As illustrated in FIG. 5, the control unit 110 includes a central processing unit (CPU) 501, a read-only memory (ROM) 502, a random access memory (RAM 503), and a hard disk drive (HDD) 504. When the image forming apparatus 1 is turned on, the CPU 501 reads a boot program from the ROM 502 and launches the boot program. Further, using the RAM 503 as a working storage, the CPU 501 reads out and executes an operating system (OS), one or more control programs, and/or the like from the hard disk drive (HDD) 504.

The control unit 110 further includes a network interface card (NIC) 505. The NIC 505 performs communication for receiving print jobs with one or more devices external to the image forming apparatus 1 via a local area network (LAN) and/or the like. The control unit 110 also includes a timer 506. The CPU 501 sets a time-out time to the timer 506, and when the time-out time elapses since activation of the timer 506 by the CPU 501, the timer 506 outputs a time-out interrupt to the CPU 501.

The control unit 110 further includes a digital-to-analog converter (DAC) 407. The DAC 407 receives a digital signal from the CPU 501, and outputs analog signals (e.g., the heater current instruction signal IREF, the PI constant selection signal PIS, and the filter characteristic selection signal FS) to the filter FL1.

Further, the CPU 501 is capable of acquiring the temperature of the fixing device 141 by referring to the temperature sensor 121 of the fixing device 141. Further, the control unit 110 also includes an operation panel 510. The operation panel 510 is controlled by the CPU 501 and performs operations of, for example, presenting information to users and receiving input of instructions from users. For example, the operation panel 510 includes one or more hardware keys and a touch panel composed of a touchpad and a liquid crystal display.

[4] Control And Operations Of Power Supply Control Device 100

The following describes the control and operations of the power supply control device 100.

The supply of power by the power supply control device 100 to the halogen heater 120 is controlled by the control unit 110. Further, the following description is based on a configuration where the control unit 110, when stopping the supply of power from the power supply control device 100 to the halogen heater 120 (i.e., when turning off the halogen heater 120), stores the time point at which the halogen heater 120 has been turned off (heater off time) to the HDD 504.

Figure 6:
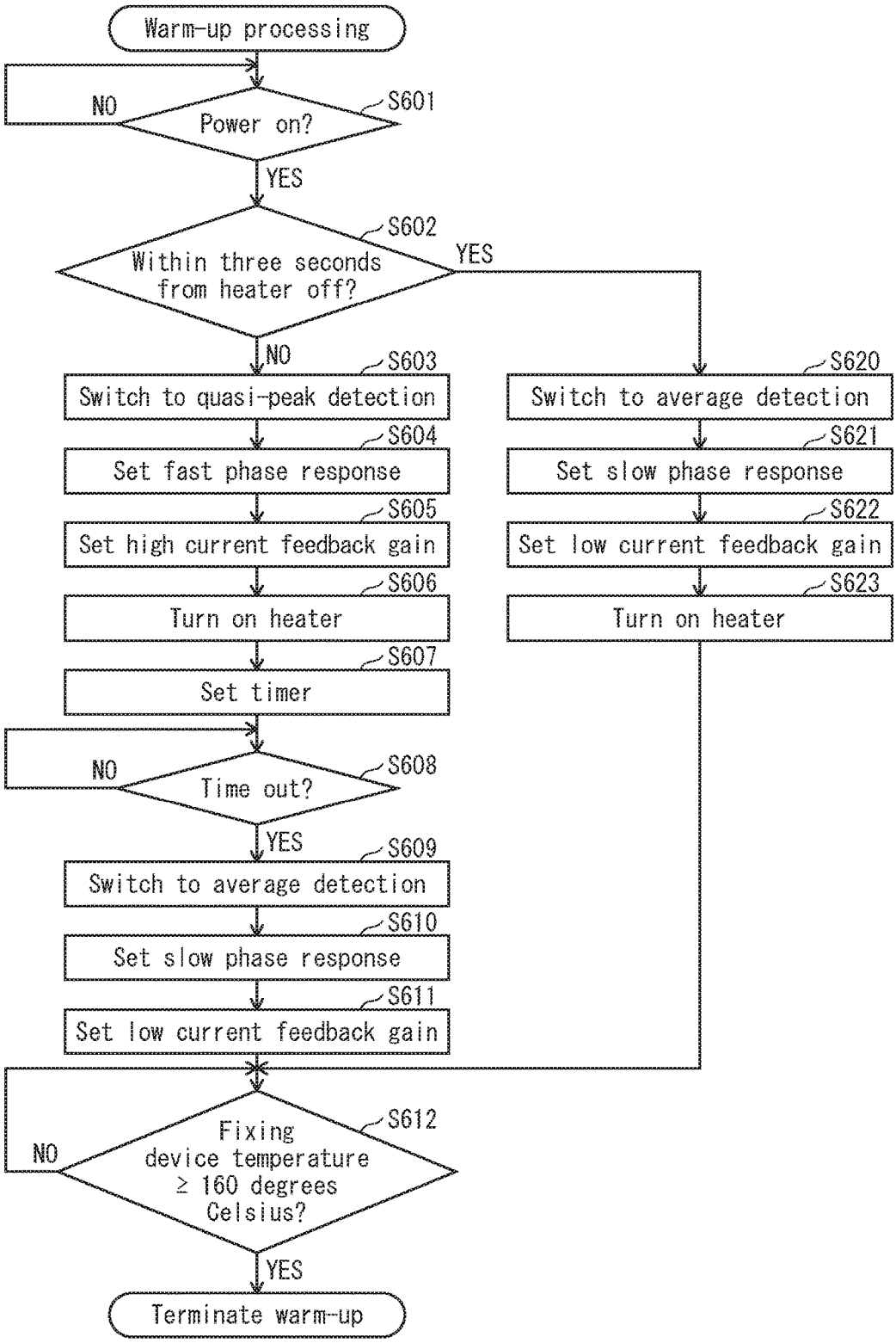
FIG. 6 is a flowchart illustrating operations of the control unit 110.

As illustrated in FIG. 6, the control unit 110 first judges whether the image forming apparatus 1 has been turned on (Step S601). The control unit 110 activates when judging that the image forming apparatus 1 has been turned on (YES in Step S601), and refers to the latest heater off time and the present time to judge whether the present time is within three seconds from the latest heater off time (Step S602). When the present time is within three seconds from the latest heater off time (YES in Step S602), the control unit 110 judges that the temperature of the halogen heater 120 is high enough, and thus, that inrush current would not be so high. Thus, the control unit 110 outputs the filter characteristic selection signal FS to set the characteristic of the filter FL1 to average detection (Step S620).

In this case, the control unit 110 then outputs the PI constant selection signal PIS to set the phase characteristic of the phase compensator OA1 to that for average detection (S621), outputs the heater current instruction signal IREF to set the gain of the current feedback signal to that for average detection (Step S622), and commences warm-up of the filing device 141 by turning on the halogen heater 120 (Step S623).

Subsequently, the control unit 110 refers to the temperature sensor 121 to judge whether or not the temperature of the fixing device 141 is 160 degrees Celsius or higher (Step S612). When judging that the temperature of the fixing device 141 has increased to 160 degrees Celsius or higher (YES in Step S612), the control unit 110 terminates the warm-up of the fixing device 141.

By performing such processing, feedback control can be performed so that the average value of the heater current matches the current amount specified by the heater current instruction signal IREF. Further, because current control is executed by performing "chopping" through equal pulse width modulation so that the heater current remains constant, a sinusoidal current waveform is always maintained, which means that 100% power factor is always maintained. In addition, equal pulse width modification is also advantageous in that simple control is achieved due to the output of an equal width pulse.

Further, when the filter characteristic of the filter FL1 is set to average detection, the current feedback signal IFB2 substantially equals the average of the full-wave rectification signal IFB1. As illustrated in FIG. 7, this is due to the full-wave rectification signal IFB1 having a ripple voltage whose frequency is twice the commercial frequency (i.e., the frequency of the AC power from the external power source 160).

While setting the filter characteristic of the filter FL1 to average detection suffices when the temperature of the halogen heater 120 is high enough, setting the filter characteristic to average detection is problematic when warming up the halogen heater 120 from the cold state (i.e., upon cold start of the halogen heater 120). Specifically, when the halogen heater 120 is cold, the resistance of the halogen heater is extremely low, which means that extremely great heater current flows when the halogen heater 120 is activated. If the filter characteristic were set to average detection with the halogen heater 120 in such a state, current feedback would not be performed quick enough, and thus, the switch element Q1 could be destroyed for an extremely great current flowing therethrough. Due to this, the following processing is executed upon cold start of the halogen heater 120.

When the current time is three or more seconds from the latest heater off time (NO in Step S602), the control unit 110 judges that the temperature of the halogen heater 120 is not high enough, and thus, that there is a risk of high inrush current. Thus, the control unit 110 outputs the filter characteristic selection signal FS to set the characteristic of the filter FL1 to quasi-peak detection (S603).

In this case, the control unit 110 then outputs the PI constant selection signal PIS to set the phase characteristic of the phase compensator OA1 so that the response of the phase compensator OA1 is faster compared to when the filter FL1 is set to average detection (S604), outputs the heater current instruction signal IREF to set the gain of the current feedback signal to a gain higher than that for average detection (Step S605), and commences warm-up of the filing device 141 by turning on the halogen heater 120 (Step S606).

Subsequently, the control unit 110 sets the time-out time (for example, 0.5 seconds in the present embodiment) of the timer 506 (Step S607), and then waits for the elapse of the time-out time (Step S608). When the time-out time elapses (i.e., when time out occurs) (YES in Step S608), the control unit 110 judges that the temperature of the halogen heater 120 has increased to a sufficient temperature, and thus, that there is no longer a risk of high inrush current. Then, the control unit 110 outputs the filter characteristic selection signal FS to set the characteristic of the filter FL1 to average detection (S609).

Further, the control unit 110 then outputs the PI constant selection signal PIS to set the phase characteristic of the phase compensator OA1 so that the response of the phase compensator OA1 becomes slower (S610), and outputs the heater current instruction signal IREF to set the gain of the current feedback signal to a lower gain (Step S611). Subsequently, the control unit 110 refers to the temperature sensor 121, and when the temperature of the fixing device 141 has increased to 160 degrees Celsius or higher (YES in Step S612), the control unit 110 terminates the warm-up of the fixing device 141.

By performing such processing, the filter characteristic of the filter FL1 is set to quasi-peak detection upon cold start of the halogen heater 120. As a result, the voltage value of the current feedback signal IFB2 becomes higher than that for average detection as illustrated in FIG. 7, and thus, response latency can be prevented. Accordingly, even if high inrush current flows upon cold start of the halogen heater 120, great current feedback is returned and thus, heater current can be suppressed.

In addition, the current feedback changes as the temperature of the halogen heater 120 increases and the resistance of the halogen heater 120 increases. Thus, the amount of time over which heater warm-up is performed can be optimized with this configuration compared to the conventional configuration where input voltage is always restricted for a fixed amount of time determined in advance.

That is, for example, with the conventional configuration, the amount of time for which input voltage is restricted needs to be determined based on the worst case where heater temperature is lowest (e.g., heater temperature in the morning at the start of the working hours). Due to this, with the conventional configuration, the input voltage is restricted for an unnecessarily long amount of time and warm-up time is unnecessarily extended inevitably even under a condition where the heater temperature actually increases to the sufficient level very quickly, such as immediately after printing.

Meanwhile, the configuration pertaining to the present embodiment achieves flexible adjustment of heater current by utilizing current feedback, for example under a condition where the heater temperature is not so low and the resistance of the halogen heater 120 increases relatively quickly, such as immediately after printing. That is, with the configuration pertaining to the present embodiment, the amount of time it takes for heater warm-up changes in accordance with the rate at which the temperature of the halogen heater 120 increases.

[5] Modifications

Up to this point, the present invention has been described based on a specific embodiment thereof. However, the present invention is clearly not limited by the embodiment, and for example, modifications such as those described in the following may be made without departing from the spirit and scope of the present invention.

(1) In the embodiment, the detection of heater current is performed by using the current transformer CT1 arranged along the circuit extending from the N wire of the external power source 160 to point b of the bridge rectifier circuit 201. However, the detection of heater current need not be performed in such a manner.

For example, the detection of heater current may be achieved by detecting the current flowing into the step-down chopper circuit or the current flowing out from the step-down chopper circuit. Specifically, the detection of heater current may be achieved by inserting a current sensing resistor or a DC current transformer along the circuit extending from point c of the bridge rectifier circuit 201 to the switch element Q1 and then to the halogen heater 120. The same effects as those described above can also be achieved with this modification.

(2) In the embodiment, a configuration is described of setting the filter characteristic of the filter FL1 to quasi-peak detection for a predetermined amount of time (referred to as initial period in the following) from cold start of the halogen heater 120, and setting the filter characteristic of the filter FL1 to average detection once the initial period elapses. However, the setting of filter characteristic need not be performed in such a manner.

For example, upon elapse of the initial period, an intermediate filter characteristic (quasi-peak detection) between the quasi-peak detection during the initial period and average detection may be set as the filter characteristic of the filter FL1, instead of average detection. That is, the same effects as those described above can also be achieved as long as the filter characteristic set upon elapse of the initial period has a longer charge time constant, a shorter discharge constant, and/or the like than the filter characteristic set during the initial period, even if the filter characteristic set upon elapse of the initial period is not average detection in a strict sense and has shorter charge time constant, a longer discharge time constant, and/or the like than average detection.

(3) In the embodiment, feedback control of the heater current is performed while setting the filter characteristic of the filter FL1 to quasi-peak detection during the initial period, and then, once the initial period elapses, setting the filter characteristic of the filter FL1 to average detection. However, feedback control of the heater current need not be achieved in such a manner.

For example, the feedback control of the heater current may be achieved by making the following modification. Specifically, during the initial period from cold start of the halogen heater 120, heater current is suppressed with great current feedback by setting a high gain to the amplifier GA2, or in other words, increasing the gain of the current feedback signal IFB2 by appropriately controlling a switching signal FS4 (illustrated in FIG. 3) by using the filter characteristic selection signal FS that the control unit 110 outputs. Then, upon elapse of the initial period, the gain of the current feedback signal IFB2 is decreased. The same effects as those described above can also be achieved with this modification.

(4) While not explicitly described in the embodiment, cold start of the halogen heater 120 is performed when the image forming apparatus 1 is in a warm-up mode or a standby mode. Due to this, a modification may be made such that the control unit 110 performs the control of the filter characteristic selection signal FS for setting the filter characteristic of the filter FL1 to quasi-peak detection during the initial period, only when the image forming apparatus 1 is in the warm-up mode or the standby mode.

By making such a modification, it can be ensured that that the filter characteristic of the filter FL1 is set to average detection even during the initial period given that the image forming apparatus 1 is, for example, in a printing mode. Thus, this modification achieves appropriate control of the fixing temperature of the fixing device 141.

(5) In the embodiment, description is provided based on an example where the image forming apparatus 1 is a color printer having the tandem system. However, the present invention is not only applicable to color printers having the tandem system, and is also applicable to other printers, such as color printers without the tandem system and monochrome printers. Further, the present invention achieves the same effects as those described above when applied to devices such as copiers with a scanner function, facsimile devices with a communication function, and multifunction peripherals (MFPs) having various functions including the above-described functions.

[6] Conclusion

One aspect of the present invention is a power supply control device in an image forming apparatus that heat-fixes a toner image by using a halogen heater, the power supply control device receiving AC power from an external power source and supplying the halogen heater with a heater current, the power supply control device including: a rectifier circuit performing full-wave rectification of the AC power to output full-wave rectified power; a chopper circuit generating the heater current from the full-wave rectified power; a current feedback circuit generating a current feedback signal indicating a current amount based on an amount of the heater current; and a constant current control circuit performing pulse-width modulation of the amount of the heater current according to a difference between a target amount of the heater current and the current amount indicated by the current feedback signal, wherein the current feedback circuit is capable of switching between a plurality of methods for generating the current feedback signal, the methods at least including a first method and a second method, the current feedback signal indicating a greater current amount with the first method than with the second method, and the current feedback circuit uses the first method during an initial period that is a period with a predetermined time length starting from when the halogen heater is turned on, and uses the second method after elapse of the initial period.

Due to the current feedback circuit using the first method for the generation of the current feedback signal during the initial period, the power supply control device suppresses inrush current flowing upon cold start of the halogen heater. Further, the constant current control circuit performs pulse-width modulation of the amount of the heater current according to the difference between the target amount of the heater current and the current amount indicated by the current feedback signal. Thus, a situation where heater current is suppressed unnecessarily is avoided, and due to this, the power supply control device prevents unnecessary extension of warm-up time.

In the power supply control device pertaining to one aspect of the present invention, the current feedback signal may indicate a current amount closer to an average value of the amount of the heater current with the second method than with the first method.

In the power supply control device pertaining to one aspect of the present invention, the current feedback circuit may use a greater charge time constant with the second method than with the first method.

In the power supply control device pertaining to one aspect of the present invention, the current feedback circuit may use a smaller discharge time constant with the second method than with the first method.

In the power supply control device pertaining to one aspect of the present invention, a gain of the current feedback circuit for generating the current feedback signal may be greater with the first method than with the second method.

In the power supply control device pertaining to one aspect of the present invention, the constant current control unit may include a phase compensator performing phase compensation of the current feedback signal, and the phase compensator may have higher response speed during the initial period than after the elapse of the initial period.

In the power supply control device pertaining to one aspect of the present invention, the current feedback circuit may receive a control signal from a hardware processor that judges whether a predetermined time amount has elapsed since termination of supply of the heater current to the halogen heater, and when the control signal indicates that the hardware circuit has judged that the predetermined time amount has elapsed since the termination of supply of the heater current to the halogen heater, the current feedback circuit may use the second method instead of the first method during the initial period.

In the power supply control device pertaining to one aspect of the present invention, the constant current control circuit may perform equal pulse-width modulation.

In the power supply control device pertaining to one aspect of the present invention, the current feedback circuit may refer to an alternating current before the full-wave rectification by the rectifier circuit for generating the current feedback signal.

In the power supply control device pertaining to one aspect of the present invention, the current feedback circuit may refer to a current flowing into the chopper circuit or a current flowing out from the chopper circuit for generating the current feedback signal.

One aspect of the present invention is an image forming apparatus that heat-fixes a toner image by using a halogen heater, the image forming device including: a power supply control device receiving AC power from an external power source and supplying the halogen heater with a heater current, the power supply control device including: a rectifier circuit performing full-wave rectification of the AC power to output full-wave rectified power; a chopper circuit generating the heater current from the full-wave rectified power; a current feedback circuit generating a current feedback signal indicating a current amount based on an amount of the heater current; and a constant current control circuit performing pulse-width modulation of the amount of the heater current according to a difference between a target amount of the heater current and the current amount indicated by the current feedback signal; a hardware processor controlling the power supply control device; and a fixing device heat-fixing a toner image formed on a recording sheet onto the recording sheet by using the halogen heater, wherein the current feedback circuit is capable of switching between a plurality of methods for generating the current feedback signal, the methods at least including a first method and a second method, the current feedback signal indicating a greater current amount with the first method than with the second method, and the current feedback circuit uses the first method during an initial period that is a period with a predetermined time length starting from when the halogen heater is turned on, and uses the second method after elapse of the initial period.

The image forming apparatus pertaining to one aspect of the present invention may further include a temperature detector that detects a fixing temperature of the fixing device, and the hardware processor may provide an instruction to the constant current control circuit, the instruction indicating a target amount of the heater current that is in accordance with the fixing temperature.

The image forming apparatus pertaining to one aspect of the present invention may have a plurality of operations modes including a warm-up mode in which a fixing temperature of the fixing device is increased for heat-fixing a toner image and a standby mode in which the fixing temperature is maintained at a predetermined temperature, and when the image forming apparatus is not in the warm-up mode or the standby mode, the current feedback circuit may use the second method instead of the first method during the initial period.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A power supply control device in an image forming apparatus that heat-fixes a toner image by using a halogen heater, the power supply control device receiving AC power from an external power source and supplying the halogen heater with a heater current, and the power supply control device comprising:

a rectifier circuit which performs full-wave rectification of the AC power to output full-wave rectified power;

a chopper circuit which generates the heater current from the full-wave rectified power;

a current feedback circuit which generates a current feedback signal indicating a current amount based on an amount of the heater current; and a constant current control circuit which performs pulse-width modulation of the amount of the heater current according to a difference between a target amount of the heater current and the current amount indicated by the current feedback signal, wherein during an initial period that is a period with a predetermined time length starting from when the halogen heater is turned on, the current feedback circuit adjusts the current feedback signal according to a change of the amount of the heater current.

2. The power supply control device of claim 1, wherein the current feedback circuit selectively uses a first method for generating the current feedback signal during the initial period, and a second method for generating the current feedback signal after elapse of the initial period.

3. The power supply control device of claim 2, wherein the current feedback circuit generates the current feedback signal such that the current feedback signal indicates a current amount closer to an average value of the amount of the heater current with the second method than with the first method.

4. The power supply control device of claim 3, wherein the current feedback circuit uses a greater charge time constant with the second method than with the first method.

5. The power supply control device of claim 3, wherein the current feedback circuit uses a smaller discharge time constant with the second method than with the first method.

6. The power supply control device of claim 2, wherein a gain of the current feedback circuit for generating the current feedback signal is greater with the first method than with the second method.

7. The power supply control device of claim 1, wherein:

the constant current control circuit includes a phase compensator which performs phase compensation of the current feedback signal, and the phase compensator has a higher response speed during the initial period than after elapse of the initial period.

8. The power supply control device of claim 2, wherein:

the current feedback circuit receives a control signal from a hardware processor that judges whether a predetermined time amount has elapsed since termination of supply of the heater current to the halogen heater, and when the control signal indicates that the hardware processor has judged that the predetermined time amount has elapsed since the termination of supply of the heater current to the halogen heater, the current feedback circuit uses the second method instead of the first method during the initial period.

9. The power supply control device of claim 1, wherein the constant current control circuit performs equal pulse-width modulation.

10. The power supply control device of claim 1, wherein the current feedback circuit refers to an alternating current before the full-wave rectification by the rectifier circuit for generating the current feedback signal.

11. The power supply control device of claim 1, wherein the current feedback circuit refers to a current flowing into the chopper circuit or a current flowing out from the chopper circuit for generating the current feedback signal.

12. The power supply control device of claim 1, wherein the current feedback circuit performs output of a current feedback signal having a higher voltage value to the constant current control circuit during the initial period than after elapse of the initial period.

13. The power supply control device of claim 12, wherein the current feedback circuit includes a variable resistor and a variable capacitor, and performs the output by change of the variable resistor and the variable capacitor.

14. The power supply control device of claim 13, further comprising:

a detection circuit which detects a current flowing through the halogen heater, wherein a value of the current detected by the detection circuit is input to the current feedback circuit.

15. An image forming apparatus that heat-fixes a toner image by using a halogen heater, the image forming device comprising:

a power supply control device which receives AC power from an external power source and supplies the halogen heater with a heater current, the power supply control device comprising:

a rectifier circuit which performs full-wave rectification of the AC power to output full-wave rectified power;

a chopper circuit which generates the heater current from the full-wave rectified power;

a current feedback circuit which generates a current feedback signal indicating a current amount based on an amount of the heater current; and a constant current control circuit which performs pulse-width modulation of the amount of the heater current according to a difference between a target amount of the heater current and the current amount indicated by the current feedback signal;

a hardware processor which controls the power supply control device; and a fixing device which heat-fixes the toner image onto a recording sheet by using the halogen heater, wherein during an initial period that is a period with a predetermined time length starting from when the halogen heater is turned on, the current feedback circuit adjusts the current feedback signal according to a change of the amount of the heater current.

16. The image forming apparatus of claim 15 further comprising a temperature detector that detects a fixing temperature of the fixing device, wherein the hardware processor provides an instruction to the constant current control circuit, the instruction indicating a target amount of the heater current that is in accordance with the fixing temperature.

17. The image forming apparatus of claim 15, wherein the current feedback circuit selectively uses a first method for generating the current feedback signal during the initial period, and a second method for generating the current feedback signal after elapse of the initial period.

18. The image forming apparatus of claim 17, wherein:

the image forming apparatus has a plurality of operations modes including a warm-up mode in which a fixing temperature of the fixing device is increased for heat-fixing a toner image and a standby mode in which the fixing temperature is maintained at a predetermined temperature, and when the image forming apparatus is not in the warm-up mode or the standby mode, the current feedback circuit uses the second method instead of the first method during the initial period.

* * * * *